US010143274B2

(12) United States Patent
Sarazen

(10) Patent No.: US 10,143,274 B2
(45) Date of Patent: Dec. 4, 2018

(54) FITNESS APPARATUS

(71) Applicant: FITSTICKS LLC, Lattimore, NC (US)

(72) Inventor: Paul Sarazen, Lattimore, NC (US)

(73) Assignee: FITSTICKS, LLC, Lattimore, SC (US)

( * ) Notice: Subject to any disclaimer, the term of this patent is extended or adjusted under 35 U.S.C. 154(b) by 0 days.

(21) Appl. No.: 15/915,274

(22) Filed: Mar. 8, 2018

(65) Prior Publication Data

US 2018/0255885 A1 Sep. 13, 2018

Related U.S. Application Data

(60) Provisional application No. 62/468,465, filed on Mar. 8, 2017.

(51) Int. Cl.

| | |
|---|---|
| ***A63B 21/00*** | (2006.01) |
| ***A45B 3/00*** | (2006.01) |
| ***A45B 9/04*** | (2006.01) |
| ***A63B 21/06*** | (2006.01) |

(52) U.S. Cl.

CPC ..... *A45B 3/00* (2013.01); *A45B 9/04* (2013.01); *A63B 21/06* (2013.01); *A63B 21/4047* (2015.10); *A45B 2200/055* (2013.01)

(58) Field of Classification Search

CPC ..... A45B 3/00; A45B 9/04; A45B 2200/055; A63B 21/06; A63B 21/4047

See application file for complete search history.

(56) References Cited

U.S. PATENT DOCUMENTS

| | | | | |
|---|---|---|---|---|
| 3,004,474 | A * | 10/1961 | Hund | A61B 1/247 359/840 |
| 5,487,711 | A * | 1/1996 | Little | A63B 21/0615 482/79 |
| 8,360,938 | B2 * | 1/2013 | Gilman | A63B 21/0615 482/51 |
| 9,192,803 | B2 * | 11/2015 | Cayo | A63B 21/0618 |
| D770,571 | S * | 11/2016 | Rahnasto | D21/423 |
| 9,789,349 | B2 * | 10/2017 | Rahnasto | A63B 21/0618 |
| 2011/0224051 | A1 * | 9/2011 | Larish | A63B 21/012 482/93 |
| 2013/0143693 | A1 * | 6/2013 | Forrest, Sr. | A63B 69/345 473/444 |
| 2017/0189733 | A1 * | 7/2017 | Bentley | A63B 21/06 |
| 2017/0326402 | A1 * | 11/2017 | Sorin | A63B 21/0442 |

OTHER PUBLICATIONS http://www.fluorocarbon.co.uk/news-and-events/post/18/what-is-ultra-high-molecular-weight-polyethylene-uhmwpe archived: Apr. 10, 2017 retrieved: Jun. 26, 2018.*

* cited by examiner

*Primary Examiner* — Megan Anderson

(74) *Attorney, Agent, or Firm* — J. Bennett Mullinax, LLC

(57) ABSTRACT

An exercise apparatus is provided having a handle pivotally attached to a flat base, the base and handle having optional weights, the flat base providing resistance when the handle moves the base along a surface.

5 Claims, 3 Drawing Sheets

FITNESS APPARATUS

RELATED APPLICATION

This application claims the benefit of U.S. Provisional Patent Application No. 62/468,465, filed Mar. 8, 2017 and which is incorporated herein by reference.

FIELD OF THE INVENTION

This invention is directed towards an exercise apparatus such as an exercise stick that provides for an improvement in an exercise workout.

BACKGROUND OF THE INVENTION

This invention relates generally to exercise sticks and walking poles that are used for walking and exercise. While the therapeutic benefits of using a fitness apparatus such as an exercise stick or walking pole are well known, there remains room for improvement with respect to the process of using exercise sticks and the ability to enhance the health benefits by modifying the structure of the fitness apparatus.

Accordingly, there remains room for improvement and variation within the art.

SUMMARY OF THE INVENTION

It is one aspect of at least one of the present embodiments to provide for fitness apparatus in the form of an exercise stick or walking pole that is pivotally attached to a flat base which provides additional resistance when the fitness apparatus is used. It is a further aspect of at least one of present embodiments to provide for an exercise or walking stick having a rod, an end of the rod being adapted for engagement with a pivot member, the pivot member attached to the base which is further adapted for holding a weighted object placed on an upper surface of the flat base. In this manner, one using the walking stick for exercise can place an adjustable and variable amount of weight onto the base of the exercise apparatus. The pivot attachment between the rod and the base of the walking stick allows for flexible movement between the stick and the base as part of a walking movement. The base and weight associated with, the base increases the resistance of moving the walking stick, improves the cardiovascular benefits, and increases the muscle resistance to the user.

It is a further aspect of at least one of present embodiments to provide for a fitness apparatus comprising of or consisting of a rod, the rod pivotally attached along a lower rod terminus to a flat base, the flat base having an upper surface and a lower surface; a recess defined within the upper base surface; a plug mated to engage the recess, the plug further adapted to engage an opening of a disk weight; a bracket, secured along a center line of the flat base, the bracket defining an opening between a pair of spaced shoulders in which the lower terminus of the rod is supported therein by a fastener that extends through a pair of openings defined by the side wall of the rod, the fastener further secured along respective walls of the pair of spaced shoulders; wherein the rod is able to pivot within the bracket when the flat base of the fitness apparatus is moved along the surface by a user pushing or pulling the rod.

It is a further aspect, of at least one of present embodiments to provide for a fitness apparatus as described above wherein the recess is circular.

It is a further aspect of at, least one of present embodiments to provide for a fitness apparatus as described above wherein a container having a perimeter wall and defining a volume therein further has a bottom surface having a projection that engages the base recess.

It is a further aspect of at least one of present embodiments to provide for a fitness apparatus as described above wherein the rod has a plurality of sections joined along at least one adapter, the rod further defining a handle portion having a larger diameter stop member secured thereto, the stop member adapted for supporting a weight placed over a handle portion of the rod.

It is a further aspect of at least one of present embodiments to provide for a process of using a fitness apparatus comprising the steps of supplying a fitness apparatus having a rod, the rod pivotally attached along, a lower terminus to a flat base, the flat base having an upper surface and a lower surface; a recess defined within an upper base surface; a plug mated to engage the recess, the plug adapted to engage an opening of a weight; a bracket, secured along a center line of the flat base, the bracket defining an opening between a pair of space shoulders in which the lower terminus of the rod is supported therein by a fastener that extends through a pair of openings defined by the side wall of the rod, the fastener further secured along respective ends of the pair of spaced shoulders; wherein the rod is able to pivot within the bracket when the flat base of the fitness apparatus is moved along the surface by user pushing or pulling the rod; engaging a handle portion defined by an upper region of the rod; moving the rod in a back and forth manner, thereby sliding the flat base along a supporting surface.

It is a further aspect of at least one of present embodiments to provide for a process as described above wherein a pair of fitness apparatuses are used in tandem by an individual.

It is a further aspect of at least one of present embodiments to provide for a process as described above containing the additional step of adding a weight to the upper base surface.

It is, a further aspect of at least one of present embodiments to provide for a process as described above comprising the additional step of adding a weight to a handle portion of the rod.

It is a further aspect of at least one of present embodiments to provide for a process as described above comprising the additional step of adding a weight to the handle portion of the rod.

It is a further aspect of at least one of present embodiments to provide for a fitness apparatus as described above wherein a lower surface of the flat base defines an arcutate edge for along at least one side of the base.

It is a further aspect of at least one of present embodiments to provide for a fitness apparatus as described above wherein the bracket is positioned adjacent an edge of the flat base.

It is a further aspect of at least one of present embodiments to provide for a fitness apparatus as described above wherein the flat base is made of ultra high molecular weight polyethylene.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
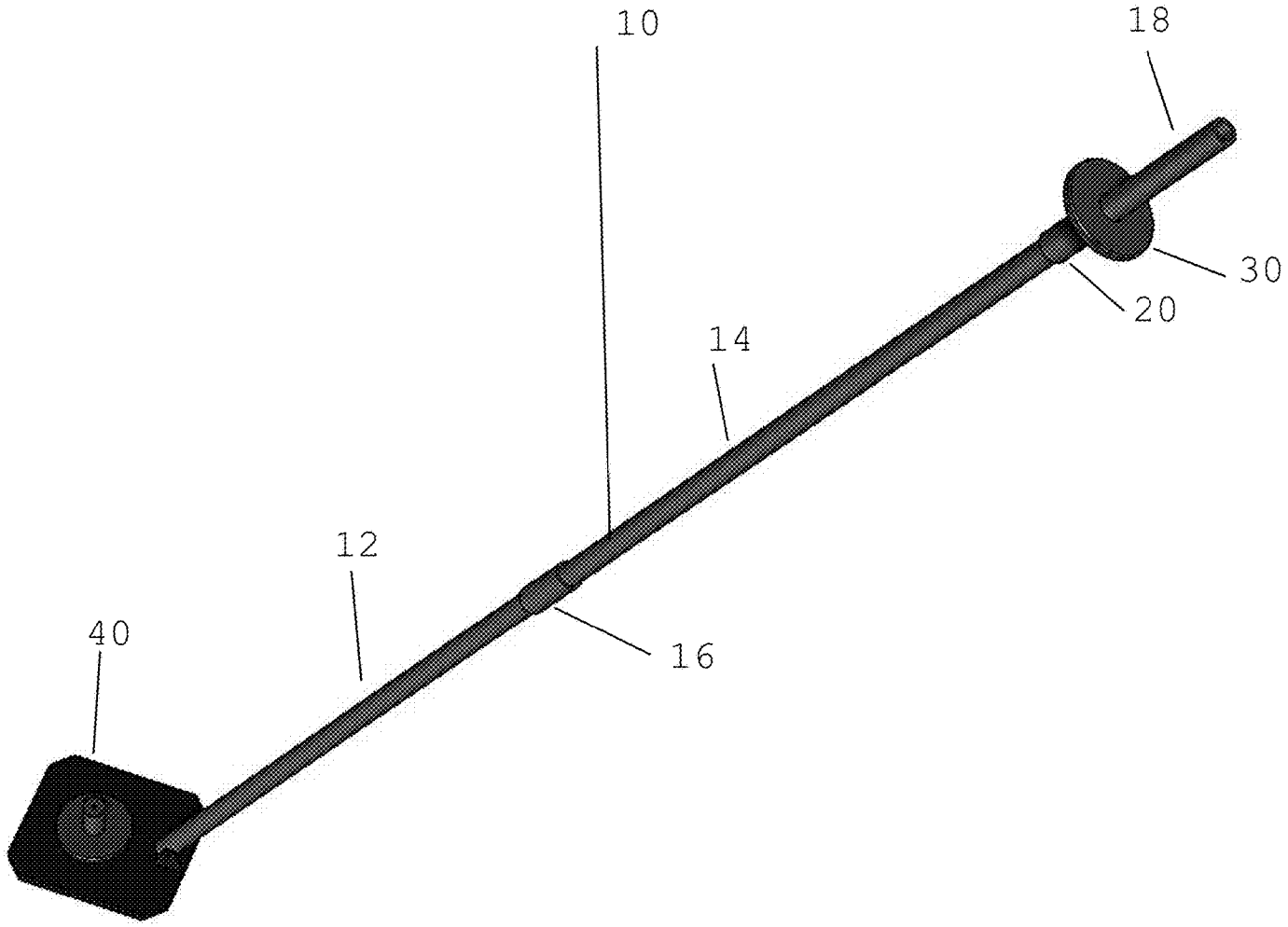
FIG. 1 is a perspective view of a fitness apparatus in the form, of a walking stick attached on one end to a base.

As best seen in reference to FIG. 1, a fitness apparatus in the form of an exercise stick 10 is provided having a lower rod 12 attached at a lower terminus to a base 40 and secured to an upper rod portion 14 via a friction fit rod connector 16. An upper end of the rod defines a handle 18, handle 18 attached to an upper terminus of rod 14. The rod portions are adapted for securing a disk weight 30, such as a bar bell weight, which can be slipped over a terminus of handle 18 and engages a stop member 20. The components of the lower rod 12, upper rod 14, rod connector 16, handle 18, and stop member 20 can be formed from hollow tubing such as PVC pipe and various connectors for PVC pipe. Optionally, the handle portion could be provided by a telescopic member using a twist release/locking mechanism such as one employed on equipment tripods having telescopic legs.

Figure 2:
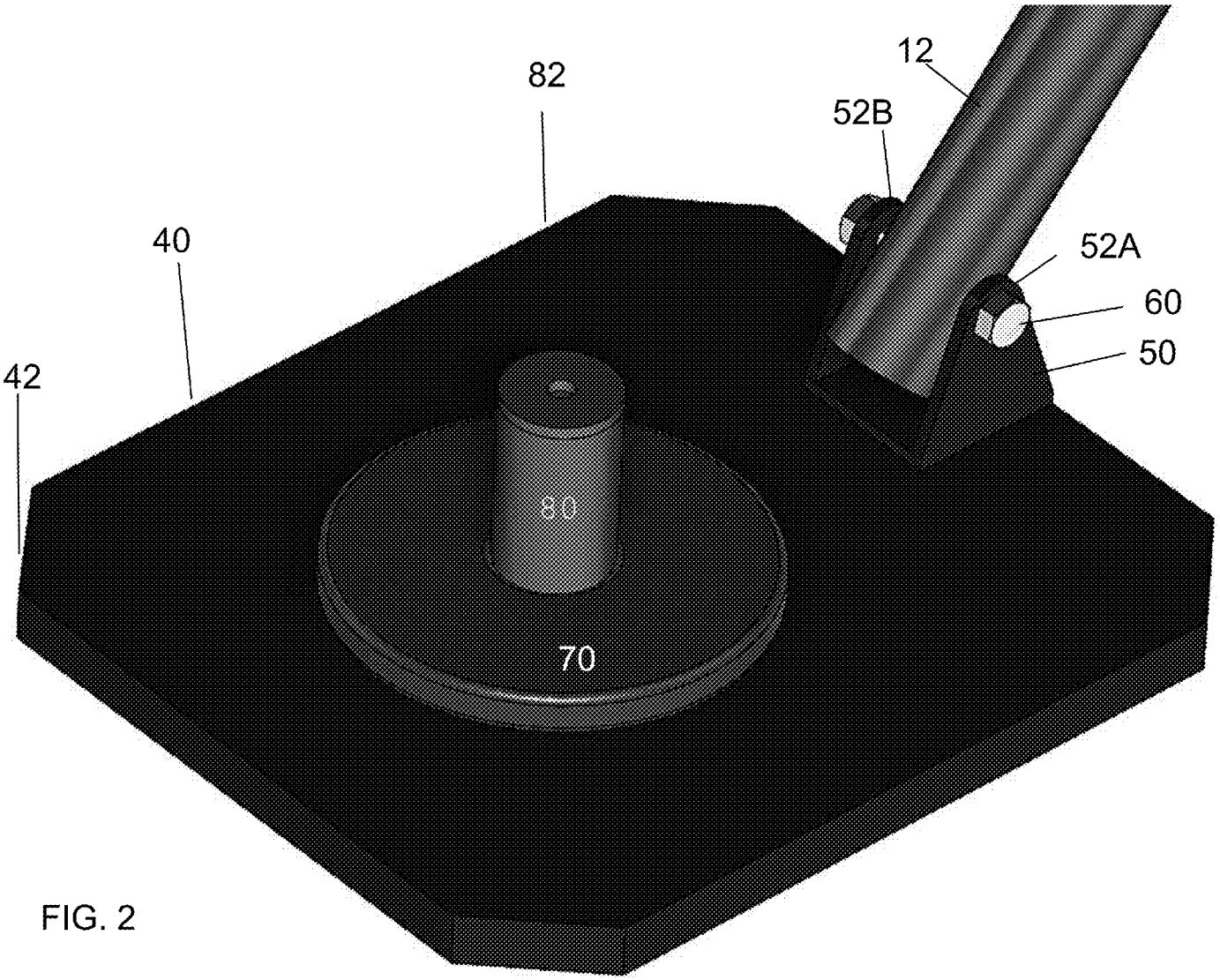
FIG. 2 is an enlarged view of the base of FIG. 1 showing the walking stick as secured to the base.

As been seen in reference to FIG. 2, the base 40 is a substantially flat substrate of a material such as ultra high molecular weight polyethylene. Other materials, such as nylon, rigid plastics, wood or metal can be utilized. As seen in reference to FIG. 2, the corners 42 of the base 40 can be angled and the corners optionally rounded so as to provide for a base structure that does not have sharp 90 degree edges. The shape of the base 40 can also be varied from square, to rectangle, to circular, to oval shaped.

As further seen in reference to FIG. 2, a bracket 50 is supported on an upper surface of base 40, bracket 50 providing an opening between two raised shoulders 52A and 52B. Within the opening defined by shoulders 52A and 526, a portion of rod 12 can be received within bracket 50 and secured within the bracket by a securing member 60 such as a pin, screw, or threaded bolt. As can be seen in reference to FIG. 2, a lower portion of the rod 12 can define a lateral bore extending through opposing side walls for receiving the securing member 60. The securement of the lower rod 12 within the bracket 50 allows for sufficient clearance at the terminal end of lower rod 12 such that the rod 12 can pivot freely in a back and forth motion within the cavity formed between shoulders 52A and 52B. This allows the lower rod 12 to pivot within bracket 50.

Preferably, bracket 50 is positioned on an edge of the upper surface of base 40 along a mid-line axis of base 40 such that when lower rod 12 is inserted, rod 12 is also positioned within the center mid line axis of base 40. Lower rod 12 is free to pivot substantially 180 degrees within bracket 50.

Figure 3:
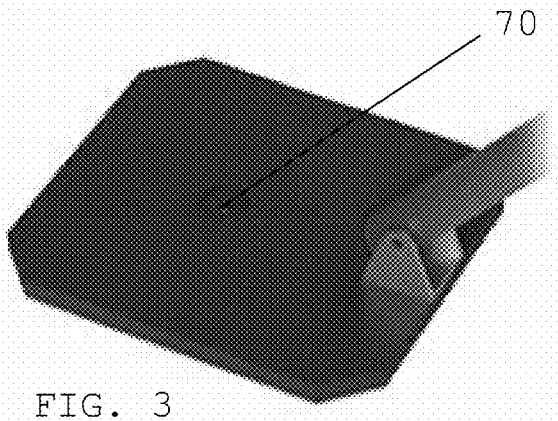
FIG. 3 is a perspective view showing details of the upper base surface.
Figure 4:
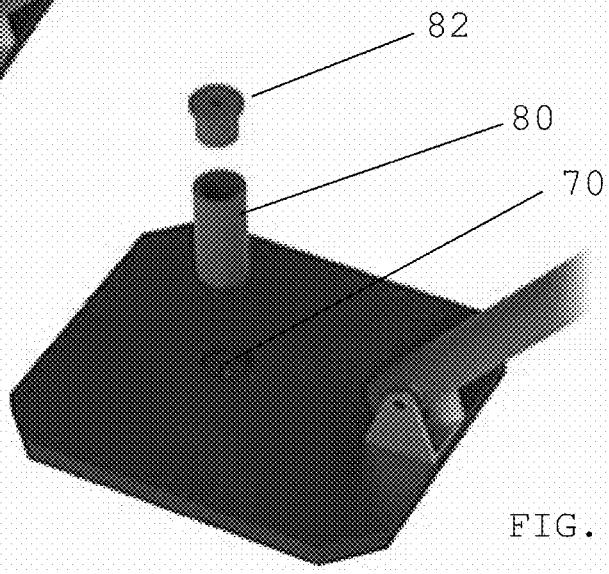
FIG. 4 is an exploded view similar to FIG. 3 showing an attachment feature for a weight added to the base.
Figure 5:
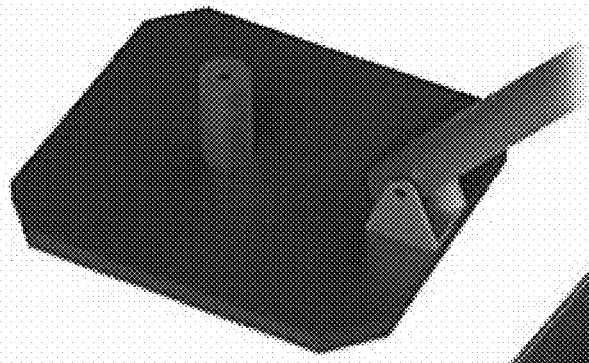
FIG. 5 shows further details of the attachment feature of FIG. 4.

As best seen in reference to FIGS. 3, 4, and 5, an upper surface of base 40 defines a recessed region 70 which may be in the shape of a circle for receiving a complimentary shaped plug 80, plug 80 being additionally engaged on an upper terminus with an end cap 82. The plug 80 will provide a securing mechanism for a weight 70 such as a flat disc weight similar to a bar bell. The additional weight allows a user of the fitness apparatus to increase the resistance of the fitness apparatus during use.

Figure 6:
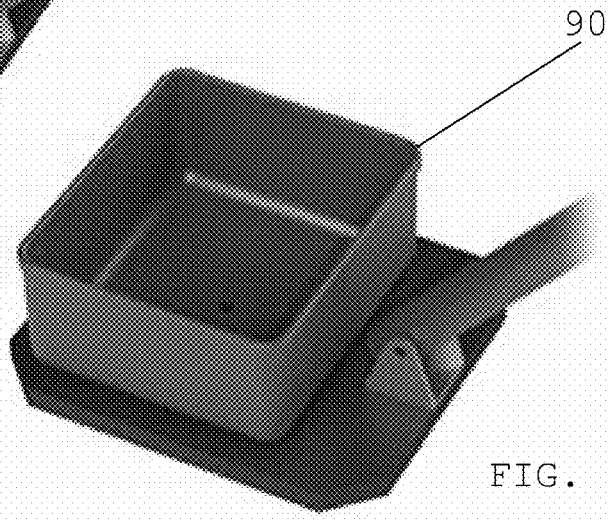
FIG. 6 is a perspective view of an alternative embodiment of the invention where the upper base supports a tray that may be used to hold weighted objects.

An optional feature, as seen in reference to FIG. 6, includes a container that can be secured to an upper surface of base 40 using a bottom projection, not shown, that is designed to engage recess 70. Container 90 can, be used to support common household articles that can be used as weights such as a gallon jug of liquid, bottled water, bean bags, stones, bricks or other items that, when placed within the interior of container 90, will provide additional weight to the fitness apparatus.

Two fitness apparatuses 10 can be used as a pair of walking sticks, one fitness apparatus 10 for each user's hand. In a preferred embodiment of a process of using the fitness sticks, the user alternates moving, their arms while holding handle 18 of the fitness sticks 10 while the base slides back and forth behind the person's body. In one preferred process, the person is stationary and is only moving the arms in a back and forth motion which moves the base 40 and any weights associated on base 40 in a sliding motion.

In one preferred embodiment, the base 40 is always maintained in a location behind the user with the user alternately extending the base behind the body and then pulling the base toward the user's body. The fitness apparatus lends itself to being used indoor on a carpeted surface where the bottom of the base can slide easily, through any smooth surface will suffice.

It is preferable that a bottom surface of the board 110 either define a low coefficient of friction material or have longitudinal rails or runners of a suitable material that facilitates use of the exercise apparatus 100 when used on hard surface flooring, carpeting, and a grassy outdoor area or walking track. If desired, rollers or wheels (not illustrated) could be placed on the bottom of the base 40.

The addition of a weight 30 to the handle 18 allows for an exercise stick that has therapeutic benefits for a user having limited mobility. An individual may remain seated in a chair and can pivot the stick handle back and forth without having to move the base 40. The weight 30 positioned on the top of pole provides for a useful back and forth pivoting motion with the increased weight providing greater resistance that offers improved muscle tone and muscle development to the user.

The various embodiments of the walking sticks described herein can also be used for exercise as a person walks. The walking can be indoors, outdoors, and, can also be used in conjunction with a treadmill. Additionally, the fitness apparatus can be moved and pivoted by a user sitting in a chair and can also be used for just a pivoting motion by keeping the base stationary while moving the rod handle back and forth along the pivot.

The exercise apparatus described herein can be used while walking and can also can be used for exercising in, place by mimicking a walking or marching motion while moving the sticks in a back and forth motion. Similarly, the weighted handles can be pivoted or pushed and pulled while standing still with or without a twisting body motion to provide additional flexibility. For less ambulatory persons, the handles can be pivoted or pushed or pulled while sitting on the side of the bed, a chair, wheelchair or other non-standing position.

Although preferred embodiments of the invention have been described using specific terms, devices, and methods, such description is for illustrative purposes only. The words used are words of description rather than of limitation. It is, to be understood that changes and variations may be made by those of ordinary skill in the art without departing from the spirit or the scope of the claims as set forth herein. In addition, it should be understood that aspects of the various embodiments may be interchanged, both in whole, or in part. Therefore, the spirit and scope of the invention should not be limited to the description of the preferred versions contained therein.

That which is claimed:

1. A fitness apparatus comprising;

a rod, the rod pivotally attached along a lower rod terminus to a flat base, the flat base having an upper surface and a lower surface;

a recess defined within the upper surface of the flat base;

a plug mated to engage the recess, the plug further adapted to engage an opening of a disk weight;

a bracket, secured along a center line of the flat base, the bracket defining an opening between a pair of spaced shoulders in which the lower rod terminus is supported therein by a fastener that extends through a pair of openings defined by a side wail of the lower rod terminus rod, the fastener further secured along respective walls of the pair of spaced shoulders;

wherein the rod is able to pivot within the bracket when the flat base of the fitness apparatus is moved along a surface by a user pushing or pulling the rod, the rod further defining a handle portion having a larger diameter stop member secured thereto, the large diameter stop member adapted for supporting a weight placed over a handle portion of the rod.

2. The fitness apparatus according to claim 1 wherein the recess is circular.

3. The fitness apparatus accordingg to claim 1 wherein a container having a perimeter wall and defining a volume therein further has a bottom surface that engages the upper base surface when the plug is not engaged to the recess.

4. The fitness apparatus according to claim 1 wherein the bracket is positioned adjacent an edge of the flat base.

5. The fitness apparatus according to claim 1 wherein the flat base is made of ultra high molecular weight polyethylene.

* * * * *